US009689646B1

(12) United States Patent
Story et al.

(10) Patent No.: US 9,689,646 B1
(45) Date of Patent: Jun. 27, 2017

(54) SYSTEM FOR MAGNETIC COUPLING

(71) Applicants: James Story, Midvale, UT (US); Michael Kerrigan, Sylvania, OH (US)

(72) Inventors: James Story, Midvale, UT (US); Michael Kerrigan, Sylvania, OH (US)

( * ) Notice: Subject to any disclaimer, the term of this patent is extended or adjusted under 35 U.S.C. 154(b) by 0 days.

(21) Appl. No.: 15/230,964

(22) Filed: Aug. 8, 2016

(51) Int. Cl.
*F41C 27/00* (2006.01)
*F41G 11/00* (2006.01)

(52) U.S. Cl.
CPC ..... *F41G 11/003* (2013.01); *F41C 27/00* (2013.01)

(58) Field of Classification Search
CPC ..... F41G 11/003; F41C 27/00
USPC ..... 42/99
See application file for complete search history.

(56) References Cited

U.S. PATENT DOCUMENTS 2,924,881 A * 2/1960 Gee ..... F41G 1/38 42/124
2011/0167703 A1* 7/2011 Deros ..... F41G 11/003 42/90
2012/0174462 A1* 7/2012 Spuhr ..... F41G 1/387 42/124
2012/0181406 A1* 7/2012 Gonzalez ..... F41G 11/003 248/316.2
2013/0180152 A1* 7/2013 Speroni ..... F41C 27/00 42/99
2014/0090286 A1* 4/2014 Kupanoff ..... F41G 11/001 42/127
2014/0325889 A1 11/2014 Michal et al.
2015/0075054 A1* 3/2015 Barger ..... F41G 11/003 42/90
2015/0354611 A1 12/2015 Wasankari
2016/0084606 A1* 3/2016 Michal ..... F41C 27/00 42/90

* cited by examiner

*Primary Examiner* — Joshua Freeman
(74) *Attorney, Agent, or Firm* — Weide & Miller, Ltd.

(57) ABSTRACT

An adapter system for attaching one or more accessories to an object comprising a first segment and a second segment, the first segment having a first bottom wherein the first bottom further comprises a first bottom chamfered recess having a central pin, the second segment having a second top wherein the second top further comprises a second top chamfered surface configured to be received into the first bottom chamfered recess and having an opening to receive the central pin, wherein one of the first top and second bottom have means of removably or slidably attaching to one or more rails and one of the first top and second bottom have means of removably attaching to one or more devices and wherein one or more of the first bottom chamfered recess and second top chamfered surface further comprises one or more strong magnets or electromagnetic field generating objects.

20 Claims, 2 Drawing Sheets

SYSTEM FOR MAGNETIC COUPLING

FIELD OF THE INVENTION

The invention generally relates to a system for coupling components, more particularly, to an adapter system for the magnetic attachment of one or more accessories to a firearm.

BACKGROUND OF THE INVENTION

Generally, adapter systems are used to attach accessories such as scopes, lasers, and flashlights to firearms. While, generally, such systems may be effective in attaching such accessories, a need exists for an adapter system which enables a user to quickly and securely attach and detach accessories to a firearm in a manner that ensures consistent mounting position.

BRIEF DESCRIPTION OF THE INVENTION

The present invention is drawn toward adapters used for attachment of accessories, specifically adapters used for attachment to gun-mounted rail systems. In the various embodiments a segment of the invention features a beveled recess that can receive the beveled surface of the other segment such that the second segment is partially within the first. Strong magnets, such as neodymium magnets, reside within or on the surface of the the interconnecting portions of the segments securing the segments together and preventing accidental separation from impact. One portion of the segment is further configured to be attached to a rail system using, for example, dovetailing or other removably attachable means, while the other segment can feature any number of attachments suitable for attaching accessories or other devices to the segment and thereby removably attaching them to the rail system.

DETAILED DESCRIPTION OF THE INVENTION

Figure 1:
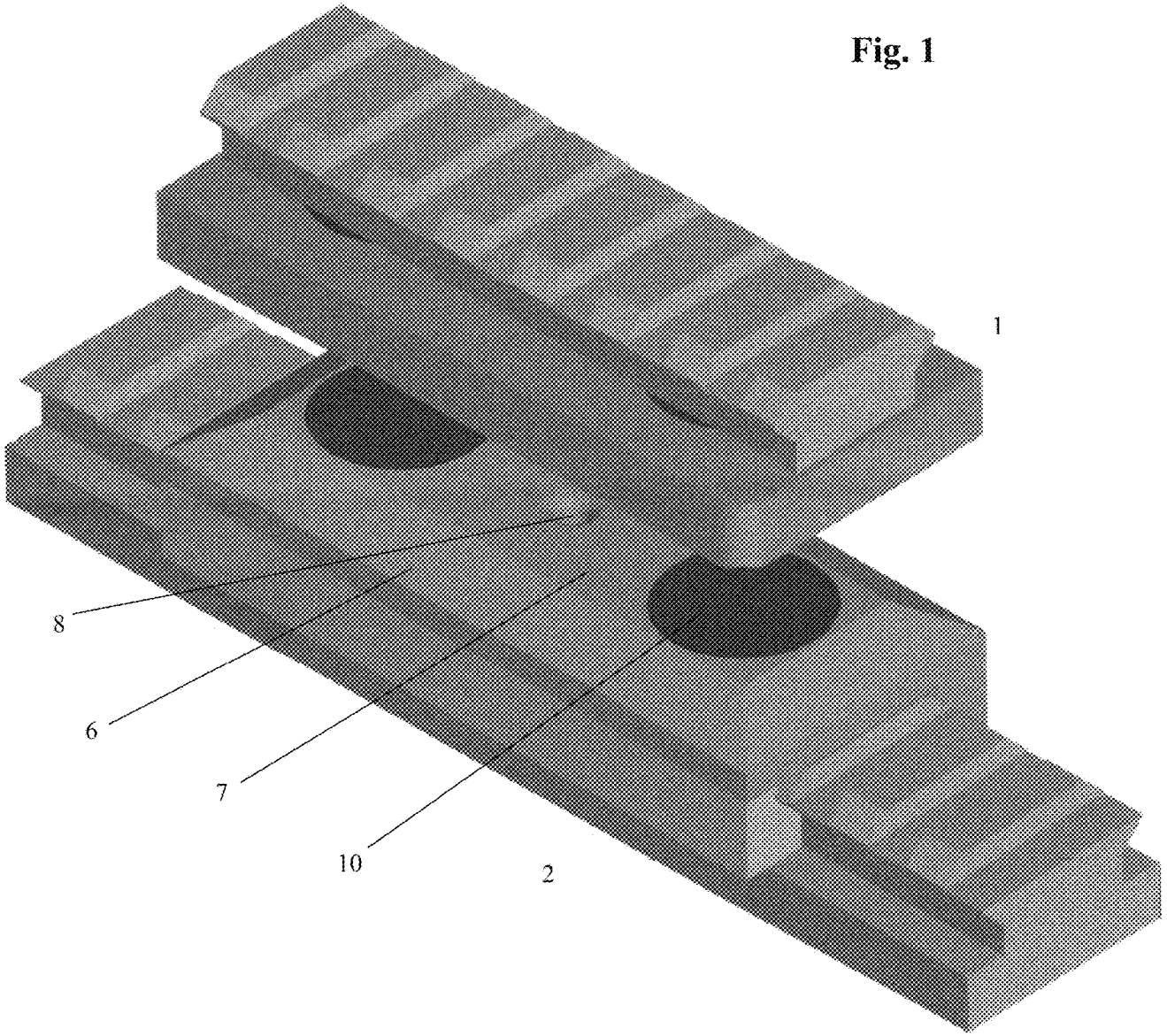
FIG. 1 upper view of invention
FIG. 2 lower view of invention
Figure 2:
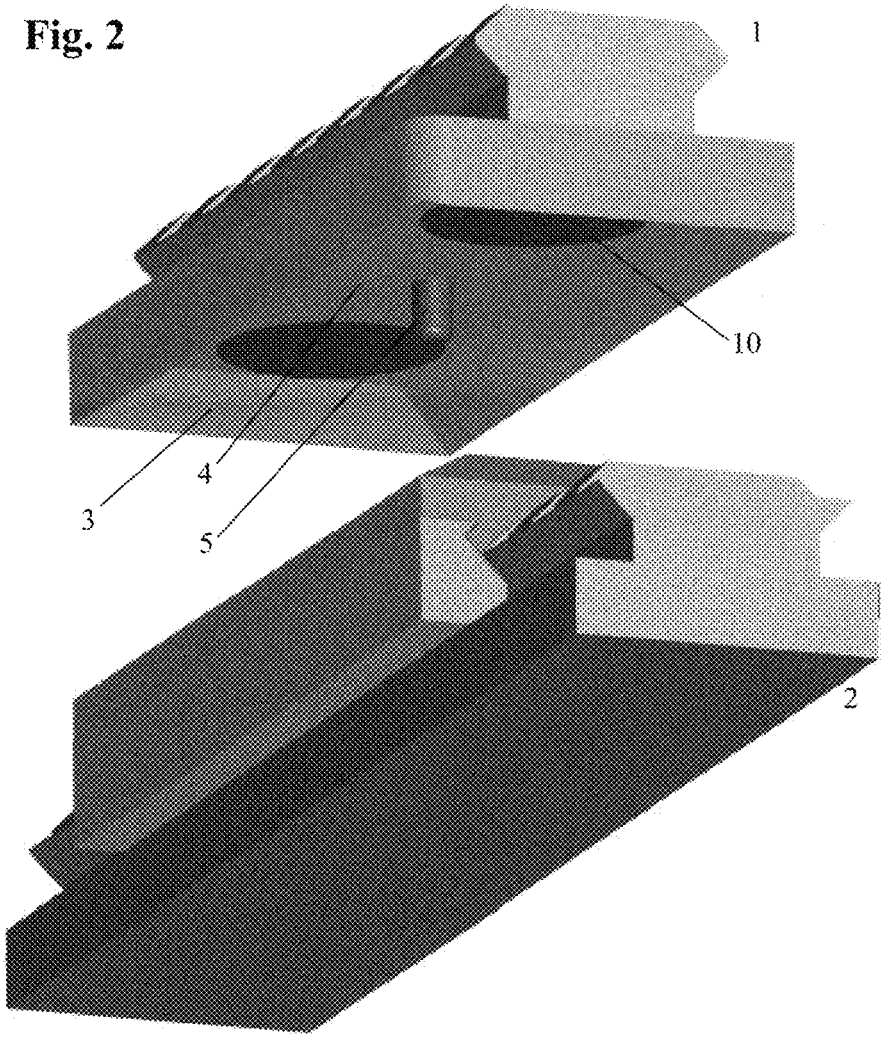

The present invention comprises two removably interconnectable segments made of a material suitable for use, such as, for example, plastic, nylon, metal, or some other material deemed to have suitable strength to weight ratio by one skilled in the art. These segments are preferably rectangular prisms but can also have other polyhedral shapes, cylindrical, or pyramidal with a variety of variations in shape. The two segments are capable of interlocking as described herein below and are further capable of attaching to various rail systems and devices or accessories commonly used with various weapons.

In the preferred embodiment a first polyhedral segment 1 of the invention has a top, a bottom, a first end, a second end and a body extending between the first and second end. The bottom, or the top, also comprises a chamfered recess 3, wherein the inner surface of the recess chamfers from the outer bottom edges of the segment to the edges of a flat surface 4 residing within the recess. The body then, in addition, extends between the top of the segment and the flat surface residing at the termination of the chamfered recess. Moreover, in the preferred embodiment, strong magnets or magnetic field generating objects, such as, for example, neodymium magnets, may reside on and level with the flat surface at the termination of the chamfered recess, or may reside within the segment body such that they are not visible or only partially visible. A pin 5 is located in the center of the flat surface within the chamfered surface. The pin 5 may be of any suitable material such as, for example, plastic, nylon, or metal, but is metal in the preferred embodiment and extends from the flat surface 4 to the edge of the edge from which the chamfer initiates inward. However, in other embodiments this pin 5 may be shorter or longer, or may be omitted altogether. The pin 5 may also be threaded, fully or partially. In addition, it is contemplated that the pin 5 may be removable and replaceable with a machine screw. Alternatively or in addition to the central pin 5, for the purpose of achieving a more exact, repeatable alignment, one or more pins of any suitable shape, such as, for example, cylindrical or conical or a combination of suitable shapes, may be placed at a number of locations on the flat surface or along the edges of the bottom of the first segment. The top of the segment preferably comprises means to attach to various types of rail mounting systems commonly found on weapons, such as, for example, picatinny rails. Such means for attaching to the rail systems may include, for example, magnets, strong magnets or other electromagnetic field generating objects, or dove tail slots extending at least a part of the length of the body of the segment.

The second segment 2 of the preferred embodiment also comprises a first end, a second end opposite the first, a top, a bottom, and a body extending between the first end and second end. The top of the second segment is configured to have a chamfered surface 6 such that the edges of the first and second ends initiate a chamfer that terminates in a flat surface 7 that is shorter in length and width than the body of the segment, such that the flat surface 7 is similar or the same size as the flat surface 4 residing within the recess of the first segment 1; that the chamfers on the first and second segment correspond or mirror one another; and that a central opening 8 on the surface corresponds to and receives the central pin 5 of the first segment. Alternatively, where one or more pins of varying shape are used, one or more corresponding openings operating to receive the one or more pins may be located anywhere on the top of the second segment 2 or along the edges of the top of the second segment 2. Furthermore, in the preferred embodiment, strong magnets 10, such as neodymium magnets, or electromagnetic field generating objects are located on the flat surface such that they are level therewith. Alternatively, the magnets may be located beneath the surface such that they are wholly or partially non-apparent. These magnets are positioned such that they correspond with the location of the magnets on the surface residing within the chamfered recess of the opposing segment, such that these magnets cause attraction between one another. On the bottom of the second segment are means for attaching to other devices or accessories commonly used or placed on weapons and rail systems, such as, for example scopes or flashlights, including, for example, scope or sight mounts, magnets, or bands capable of holding other devices.

The preferred embodiment of the invention also includes a belt or strap made of nylon, cord, or other material of appropriate tensile strength having one or more points of attachment affixed thereto by appropriate means such as, for example, rivets, snaps, or stitching. Alternatively, these points of attachment may be removably connected to the strap or belt such that they may be placed in strategic positions along the length of the belt or strap. These points of attachment further comprise chamfered recesses similar to that described above and capable of receiving the chamfered raised surface of the second segments. These straps or belts are capable of retaining one or more device attached to a second segment such that they are at the ready to be attached to a first segment attached to a rail system on a weapon.

In use the first segment is placed on a rail system, whether by sliding or other attachment manner such that it is movably or affixedly secured thereto. A second segment is attached by appropriate means to a device or accessory commonly used with weapons. The second segment can then be aligned with an attachment point of the belts or straps, thereby aligning magnets present on the surface of the chamfered recess and raised chamfered surface causing an attraction between the two segments to occur and drawing the raised chamfered surface into the chamfered recess and allowing the central pin of the recess to insert into a central opening of the raised chamfered surface securing the device or accessory to the belt or strap. In addition, the central opening may be threaded to receive a machine screw or other threaded implement. The device or accessory is then prevented from becoming removed from the belt or strap except by purposeful movement, as the magnets have a strong enough attraction to one another to prevent the raised chamfered surface from becoming dislodged from the chamfered recess. Shear forces placed on devices or the second segments are also resisted by the central pin inserted into the central opening, thereby further preventing dislodgement of the second segments and devices attached thereto.

Similarly, a second segment may be so aligned to a first segment attached to a rail, thereby causing the magnets or electromagnetic field generating objects to form a strong attraction to one another, pulling the pin from the first segment into the opening of the second segment and the body of the second segment at least partially into the recess of the first segment. To remove the second segments from the first segments or from the points of attachment on the belts or straps, a user would twist the device or second segment creating a torque. The chamfers of the recess and raised surfaces, then, act as ramps or wedges thereby converting the torque to a separation force that pulls the second segment far enough away from the first segment or the attachment points to allow a user to easily pull the second segment away thereby completely dislodging it. It is thus that a second segment may be removably attached, detached, and reattached to a first segment, thereby rendering devices and accessories connected to a second segment removably attachable to a rail system while also allowing it to withstand significant shear forces without accidentally dislodging.

We claim:

1. An adapter system for attaching one or more accessories to an object comprising:

a first segment having a first end, a second end opposite the first end, a first side, a second side opposite the first side, a top, a bottom, and a segment body extending from the first end to the second end, the first bottom comprising a chamfered recess defined by a chamfered surface extending into the bottom chamfered recess from each of the first and second ends and the first and second sides; and a second segment having a first end, a second end opposite the first end, a first side, a second side opposite the first side, a top, a bottom, and a segment body, the top of the second segment comprising a raised chamfered surface configured to be received into the chamfered recess of the first segment;

one of the first and second segments being removably attachable to the one or more accessories, and the other of the first and second segments being removably attachable to the object.

2. The adapter system of claim 1, wherein at least one of the chamfered recess and the raised chamfered surface comprises one or more magnets or electromagnetic field generating objects.

3. The adapter system of claim 1, wherein at least one of the chamfered recess and the raised chamfered surface comprises a magnetic material.

4. The adapter system of claim 1, wherein at least one of the first segment and the second segment comprise magnets or electromagnetic field generating objects embedded therein.

5. The adapter system of claim 1, wherein the chamfered recess comprises a central pin.

6. The adapter system of claim 5, wherein the raised chamfered surface comprises an opening to receive the central pin.

7. The adapter system of claim 1, further comprising one or more belts or straps configured to be worn by an individual and having one or more chamfered recesses configured to receive the raised chamfered surface.

8. The adapter system of claim 7, wherein the one or more chamfered recesses further comprise one or more strong magnets or electromagnetic field generating objects.

9. The adapter system of claim 1, further comprising means for attachment to equipment.

10. The adapter system of claim 1, wherein at least one of the chamfered recess and the raised chamfered surface comprises one or more second strong magnets or second electromagnetic generating objects to removably attach to the object.

11. An adapter system for attaching one or more accessories to an object comprising:

a first segment having a cylindrical segment body that comprises at least one chamfered recess, the chamfered recess being defined by a flat recessed surface, a first end chamfered surface extending into the chamfered recess to the flat recessed surface, a second end chamfered surface opposite the first end chamfered surface extending into the chamfered recess to the flat recessed surface, a first side chamfered surface extending into the chamfered recess to the flat recessed surface, and a second side chamfered surface extending into the chamfered recess to the flat recessed surface;

a second segment having a cylindrical segment body comprising at least one raised chamfered surface configured to be received into the at least one chamfered recess;

wherein at least one of the first segment and the second segment are configured to removably and/or slidably attach to one or more rails of the object and at least one of the first segment and the second segment is removably to the one or more accessories.

12. The adapter system of claim 11, wherein one or more of the at least one chamfered recess and the raised chamfered surface comprises one or more magnets or electromagnetic field generating objects.

13. The adapter system of claim 11, wherein at least one of the first segment and the second segment comprise magnets or electromagnetic field generating objects embedded therein.

14. The adapter system of claim 11, wherein the at least one chamfered recess comprises one or more pins, the one or more pins protruding from the flat recessed surface.

15. The adapter system of claim 14, wherein the at least one raised chamfered surface comprises one more openings to receive the one or more pins.

16. The adapter system of claim 11, further comprising one or more belts or straps configured to be worn by an individual and having one or more chamfered recesses configured to receive the at least one raised chamfered surface.

17. The adapter system of claim 16, wherein the one or more chamfered recesses further comprise one or more magnets or electromagnetic field generating objects.

18. The adapter system of claim 11, wherein at least one of the first segment and the second segment comprise a dove-tail slot to removably or slidably attach to the one or more rails.

19. The adapter system of claim 11. wherein at least one of the first segment and the second segment comprises one or more magnets or electromagnetic generating objects to removably attach to the one or more rails.

20. An adapter system for attaching one or more accessories to an object comprising:

a first segment having a first end, a second end opposite the first end, a first side, a second side opposite the first side, a top, a bottom, the bottom comprising a chamfered recess having a central pin, the chamfered recess being defined by a chamfered surface extending into the bottom chamfered recess from each of the first and second ends and the first and second sides;

a second segment having a first end, a second end opposite the first end, a first side, a second side opposite the first side, a top, a bottom, the top comprising a raised chamfered surface configured to be received into the chamfered recess and having an opening to receive the central pin;

at least one of the first segment and the second segment removably or slidably attaching to one or more rails of the object and at least one of the first segment and the second segment removably attaching to the one or more accessories, and at least one of the chamfered recess and the raised chamfered surface comprising one or more magnets or electromagnetic field generating objects.

* * * * *